US009585233B2

(12) United States Patent
Lochmann et al.

(10) Patent No.: US 9,585,233 B2
(45) Date of Patent: Feb. 28, 2017

(54) INTERFACE HAVING AN IMPROVED TRANSMITTING BRANCH

(71) Applicant: Tridonic GmbH & Co KG, Dornbirn (AT)

(72) Inventors: Frank Lochmann, Esseratsweiler (DE); Markus Schertler, Hittisau (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 15/024,501

(22) PCT Filed: Oct. 9, 2014

(86) PCT No.: PCT/EP2014/071674
§ 371 (c)(1),
(2) Date: Mar. 24, 2016

(87) PCT Pub. No.: WO2015/062837
PCT Pub. Date: May 7, 2015

(65) Prior Publication Data

US 2016/0234918 A1 Aug. 11, 2016

(30) Foreign Application Priority Data

Oct. 28, 2013 (DE) ..... 10 2013 221 848

(51) Int. Cl.
*H05B 33/08* (2006.01)
*H05B 37/03* (2006.01)
*H05B 37/02* (2006.01)

(52) U.S. Cl.
CPC ..... *H05B 37/03* (2013.01); *H05B 37/0254* (2013.01); *H05B 33/08* (2013.01); *H05B 33/0869* (2013.01)

(58) Field of Classification Search
CPC ..... H05B 37/0254
(Continued)

(56) References Cited

U.S. PATENT DOCUMENTS 5,146,357 A * 9/1992 Epstein ..... H04B 10/802 250/551
2013/0200803 A1 8/2013 Boekle
(Continued)

FOREIGN PATENT DOCUMENTS

DE 102009016904 A1 10/2010
WO 2013153510 A1 10/2013

OTHER PUBLICATIONS

International Search Report and Written Opinion issued in connection with the corresponding International Application No. PCT/EP2014/071674on Feb. 26, 2015.
(Continued)

*Primary Examiner* — Tuyet Vo
(74) *Attorney, Agent, or Firm* — The H.T. Than Law Group

(57) ABSTRACT

The invention relates to a digital bus interface for an operating device for a lighting means comprising: a transmitting branch and a receiving branch, wherein the receiving branch has a current source (Q90, Q95, R90, R91), which can be fed from a bus that carries voltage in the idle state, wherein the current source supplies at least the transmitting branch with energy and the transmitting branch has an optocoupler (U91), wherein an electrical energy store (C95) is provided in the receiving branch, which electrical energy store is charged by the current source and discharges via a resistor (100) in series with the secondary side of the optocoupler (U91) of the transmitting branch.

11 Claims, 5 Drawing Sheets

(58) Field of Classification Search
USPC .... 315/149–159, 247, 224, 209 R, 312, 291, 315/307
See application file for complete search history.

(56) References Cited

U.S. PATENT DOCUMENTS

2014/0239205 A1* 8/2014 Holtz ..... H03K 17/605 250/551
2016/0174340 A1* 6/2016 Rezeanu ..... H05B 37/0254 315/200 R

OTHER PUBLICATIONS

Machine translation of DE 102009016904 to Skatulla.

* cited by examiner

INTERFACE HAVING AN IMPROVED TRANSMITTING BRANCH

FIELD OF INVENTION

The present invention relates to an interface for a bi-directional communication with an electronic operating device for at least one lighting means and a balun with such an interface.

BACKGROUND OF THE INVENTION

An interface for DALI control signals which comprises a transmitting channel and a receiving channel both of which can be operated with a common current source is known from DE 10 2009 016 904 B4. The circuit according to the prior art is shown in FIG. 1.

In the known circuit, corresponding optocouplers U2, U1, which each form part of a branch for transmitting or respectively receiving, are provided both for the reception of DALI signals and also for the transmission of DALI signals. Both branches are fed from the common current source Q2, Q3, R3, R4. The circuit further comprises an energy store, which is illustrated in FIG. 1 as the capacitor C2.

The known interface is designed for a communication according to the DALI standard in which a specified DC-voltage is present on the lines in the case of an inactive bus. This specified DC-voltage is reduced respectively only in the case of a signal communication, while the constant DC-voltage is again present when no signals are being communicated.

According to the prior art, the capacitor C2 is charged by the DC-voltage present in the bus. This is meaningful here because, if a signal communication according to the DALI standard is taking place, precisely the voltage present in the bus falls to (logical) zero or respectively to the voltage which is defined for the low-level voltage. This can be detected directly in the return channel (transmitting branch) of the circuit.

"Return channel" relates to the channel away from the interface as the channel for the transmitting mode of the interface. The "transmitting branch" is accordingly the signal path of the interface used for the transmission of signals.

However, if signals according to a protocol in which the voltage is zero (or very low by comparison with the DALI standard) in the non-operating state of the bus are received by the interface instead of DALI signals, the known interface may then not be suitable for this. An example for such a standard is the so-called DSI standard.

The reason for this is that, by contrast with the DALI standard, according to the DSI standard, no voltage or respectively a low voltage is present in the case of an inactive bus (the "low level", that is, the low value for the transmission of a first logical state, for example, 0, is specified at <6.5 V). The voltage in the bus is raised only in the case of a transmission of a DSI signal.

Consequently, if a DSI signal arrives at the terminal for the operating device, that is, at the secondary side of the known interface, the voltage jumps abruptly from the value for the first logical state, for example, < 6.5 V, to a specified DC-voltage, for example, 10-15 V (high-level, that is, the voltage value which is interpreted as the second logical value, for example, 1). It is now.necessary for the incoming signal to be detected immediately in order to guarantee a reliable detection of the DSI signal. In the case of DSI, the transmission takes place with a Manchester coding, that is, one data bit is transmitted through a change from low-level to high-level (logical 0) or respectively a change from high-level to low-level (logical 1).

However, in this context, the capacitor C2 from the known circuit acts in a disturbing manner, because the falling edge (logical 1) or respectively the first bit of the DSI signal cannot be reliably detected by the known interface.

This is because, after adopting the high-level (for approximately 833 μs), the capacitor C2 is partially charged as a result of the 2 mA input current source. In the case of a decline of the bus voltage to below 6.5 V, the capacitor C2 is further charged. In consequence, current also flows in the optocoupler U2 of the receiving branch, and the first logical state (for example, 1) cannot therefore be detected at the optocoupler output of the optocoupler U2 immediately after falling below 6.5 V. The capacitor C2 is in fact still partially charged even after the undercutting of the low-level and, in the non-charged or partially charged state, bridges the Zener diode Z1, which otherwise immediately interrupts the current flow in the optocoupler U2 when the Zener voltage (low level) is undercut.

BRIEF SUMMARY OF THE INVENTION

The object of the invention is therefore to provide an interface which is enhanced in the transmitting mode with regard to the edge steepness of digital signals.

The invention resolves this problem by providing an interface as claimed in claim 1. Advantageous further developments of the invention form the subject matter of the dependent claims.

A digital bus interface for an operating device for a lighting means comprises:

a transmitting and receiving branch, wherein the receiving branch comprises a current source which can be fed from a bus carrying voltage in the non-operating state, wherein the current source supplies at least the transmitting branch with energy, and the transmitting branch comprises an optocoupler, wherein, in the receiving branch, an electrical energy store, for example, one or more capacitors, is provided, which is charged by the current source, and which is discharged via at least one resistor in series with the secondary side of the optocoupler of the transmitting branch.

The resistor can be connected between the energy store and the optocoupler.

The energy store and the resistor can be dimensioned in such a manner that, during the transmission duration of one digital bit, during which a connectable bus is short-circuited, a discharge current flows.

The edge duration of one digital bit which short-circuits a connectable bus can be less than 25 mS, preferably less than 15 μS.

The energy store can be charged without charging-current control element or via a charging-current control transistor starting from the current source.

Substantial aspects of the invention will now be described with regard to the drawings.

DETAILED DESCRIPTION OF THE PREFERRED EMBODIMENTS

Figure 1:
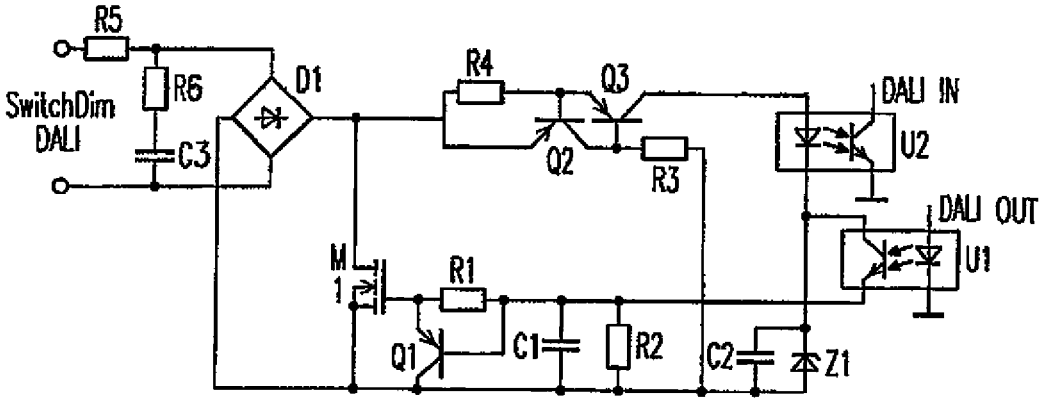
Fig. 1 Prior art
FIG. 1 an interface according to the prior art.
Figure 2:
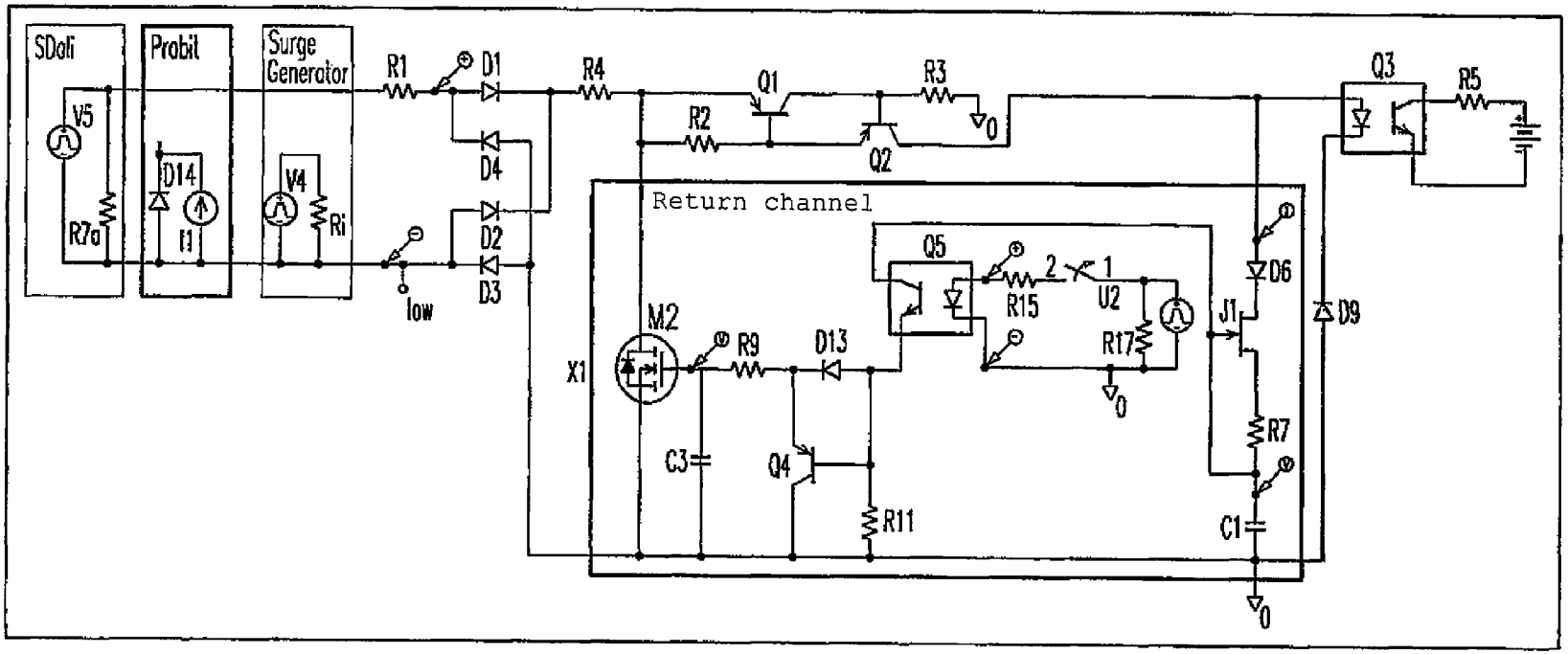
FIG. 2 a schematic view of a circuit arrangement.
Figure 3:
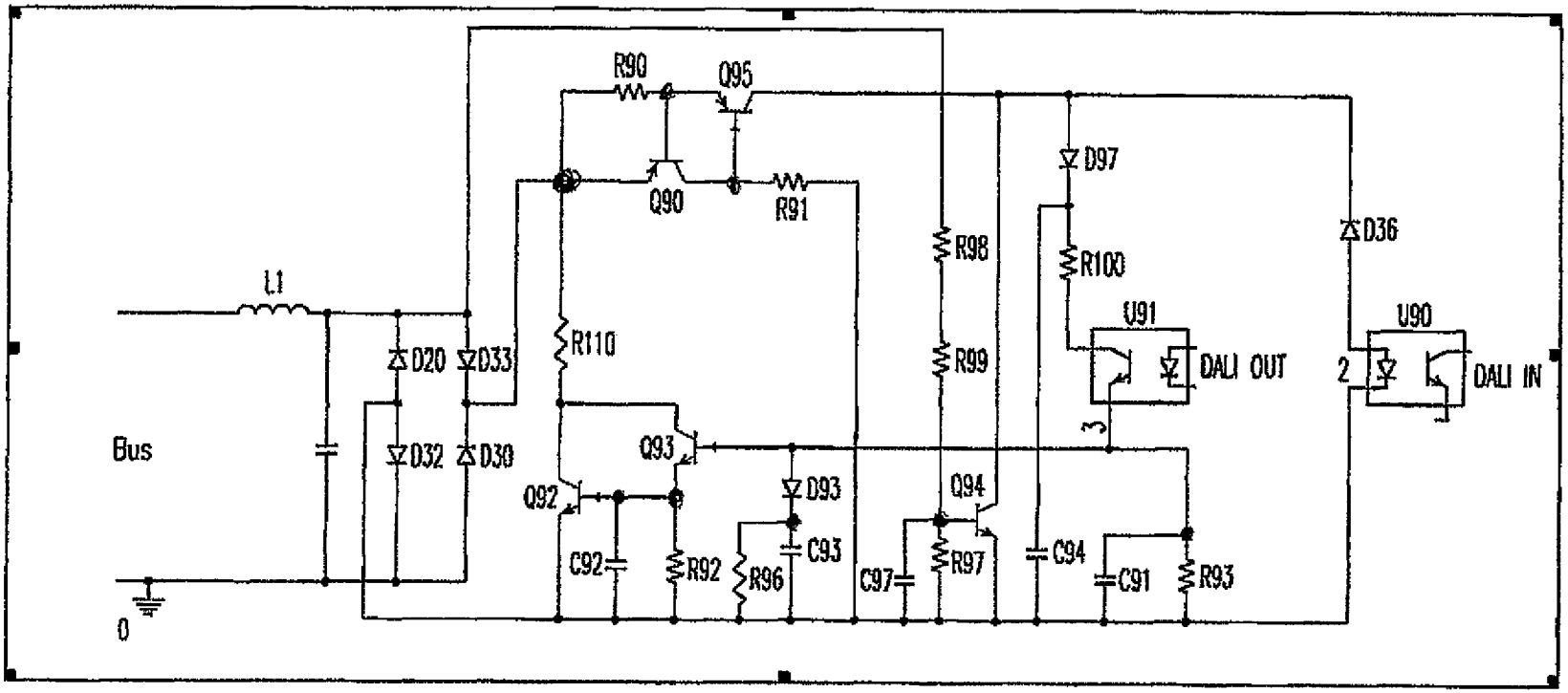
FIG. 3 a further schematic view of a circuit arrangement.

FIG. 2 shows a circuit arrangement. Here, in particular, a field-effect transistor (FET, JFET) J1 and a resistor R7 form a current source J1, R7, which supplies a charging current of specified level to an energy store, which is designated in the following by way of example as the capacitor C1.

As a result, this ensures that, on the one hand, ultimately, a constant current (input current minus charging current) flows through the optocoupler Q5. On the other hand, the effect of a non-linear component, in particular, a Zener diode D9, is not bridged by the capacitor C1. In the following, the term "Zener diode" is used to represent the non-linear component. By preference, the subdivision of the current is selected in such a manner that the charging current for the capacitor is smaller than the current through the optocoupler, preferably within a range from 30% to 70% of the optocoupler current.

The charging current for the capacitor C1 is now picked up at the input of the optocoupler Q3 of the receiving branch (see measuring point I between diode D6 and optocoupler Q3). The capacitor is therefore a part of a pathway which is connected parallel with a pathway which comprises the primary side of the receiving optocoupler Q3.

The use of the current source J1, R7 ensures that a declining edge of a DSI signal, that is, in particular, the first bit of the DSI command (start bit, logical 1, coded with declining edge), is detected rapidly and reliably. As a result of the fact that the capacitor C1 is not discharged until after the presence of the high-level, it is possible to detect directly when the voltage falls to the low-level. However, in the circuit according to the invention, a common current source can also be used for the return channel and forward channel (receiving/transmitting branch).

In addition to the use for the signal reception according to the DSI standard, the interface can also be used for signal reception according to the DALI standard. In particular, it is substantial that the arrangement according to the invention allows the very rapid detection of incoming signals, even when the non-operating state of the bus voltage is close to 0 Volt or is 0 Volt.

The circuit arrangement shown in FIG. 2 is embodied in such a manner that it counteracts the negative influence of a current source through the use of a large-dimension capacitor (with a capacitance of, for example, 1-6 μF), which is charged by the current source with the FET J1 and the resistor R7 to approximately 5.5 V or more. In this context, only a parasitic influence of the drain-source capacitance of the FET J1 is present, which can, however, be reduced through an appropriate dimensioning of the capacitance present at the gate.

In this context, FIG. 2 shows a schematic view of the interface with a first, primary-side control connection and a second primary-side control connection. On the one hand, a DALI control device SDALI, and on the other hand, a mains switch (not shown) is coupled to the primary-side control input.

In the present case, a resistor R1 is arranged in series with the first primary-side control connection. A rectifier, which comprises four diodes D1 to D4, is coupled between the resistor R1 and the second primary-side control connection. A switch X1 is coupled between a first and a second rectifier output connection, especially its pathway between operating electrode—reference electrode. Furthermore, a current source, which comprises two bipolar transistors Q1, Q2 and two ohmic resistors R2, R3 is also coupled to the rectifier output connection. A first optocoupler Q3, which is coupled in series with a Zener diode D9, is coupled to the output of the current source. A series circuit comprising a diode D6, the current source J1, R7 consisting of FET J1 and resistor R7, and a capacitor C1, is coupled in parallel with the Zener diode D9. A second optocoupler Q5 is supplied via the current source R7, J1.

The optocoupler Q3 in the receiving branch can transfer signals via an output of the interface with a first and a second output connection, while the second optocoupler Q5 in the transmitting branch is provided for the transmission of signals via a signal input with a first and a second signal connection.

The output of the optocoupler Q5 is connected to the control electrode of the switch X1, wherein a diode D13 and a resistor R9 are connected in series on this pathway. In parallel with the control electrode of the switch X1, a parallel circuit of a capacitor C3 and a resistor R11 is configured, which act as interference filters. A further bipolar transistor Q4, of which the base is coupled to the higher-potential side of the resistor R11, is coupled between the capacitor C3 and the resistor R11.

Through the use of the current source J1, R7 for the charging of the capacitor C1 (the latter corresponds substantially with the capacitor C2 of the known circuit), the full functionality is then also ensured in the case of the transmission of signals according to the DSI standard, because a charging of the capacitor C1 no longer occurs with a declining edge, but also according to the DALI standard. The capacitor C1 is consequently always charged, thereby eliminating a bridging of the Zener diode D9 through a non-charged or partially charged condition with a declining edge.

After a switching on of the mains voltage and accordingly a presence of a DC-voltage at a predetermined level according to the DALI standard ($DALI_{in}$), the capacitor C1 is charged to approximately 5.5 Volt or more in around 400 ms, so that a response to a DALI signal can be transmitted with certainty after 600 ms (this corresponds to the DALI standard) from the switching-on time.

In this context, the charging current is limited by the current source consisting of FET J1 and resistor R7, for example, to 100 μA. However, this value can also be higher or lower dependent upon the components used.

As a result, the optocoupler Q5 is always driven with a defined current, wherein the current through FET J1 is selected in such a manner that, with a transmission of a DSI signal, an influence on the bit time, that is, the time in which a bit can be transmitted from the transmitter to the receiver, is small.

The circuits shown can be modified as follows. For example, if the control voltage for the FET X1, that is, the voltage in C1, is to be increased, an optocoupler Q5 with a control current of approximately 1 milliamp, instead of, for example, 5 milliamps (mA), can therefore be used. This can be, for example, an optocoupler of the type TLP621 or TLP624 manufactured by Toshiba.

By reducing the optocoupler current to 1 milliamp, more current (for example, 600 micro-amps) can be permitted for the charging of the capacitor C1, so that the voltage in C1 reaches its set value more quickly, and has therefore also reached an even higher value at the time of the transmission after 600 ms. Furthermore, the diodes D6 and D13 can be replaced with Schottky diodes, so that the control voltage at the gate of the switch X1 can be raised by approximately 0.5 V if necessary. This then allows a use of an FET X1 of smaller dimension.

A circuit according to the invention will now be explained with reference to two variants on the basis of FIGS. 4 and 5.

The invention relates, in particular, to the enhancement with regard to signal shape and signal repetition in the case of digital bits to be transmitted in the transmitting branch.

Figure 4:
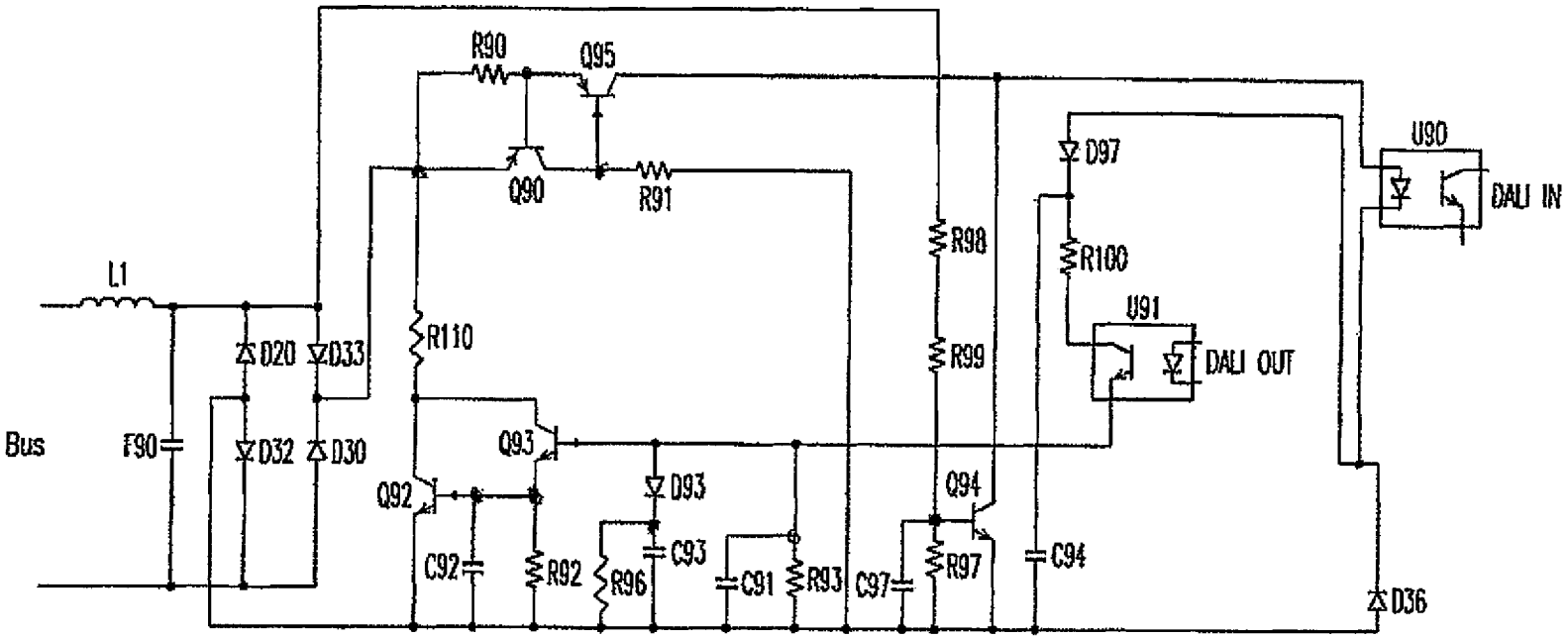
FIG. 4 a first embodiment according to the invention.
Figure 5:
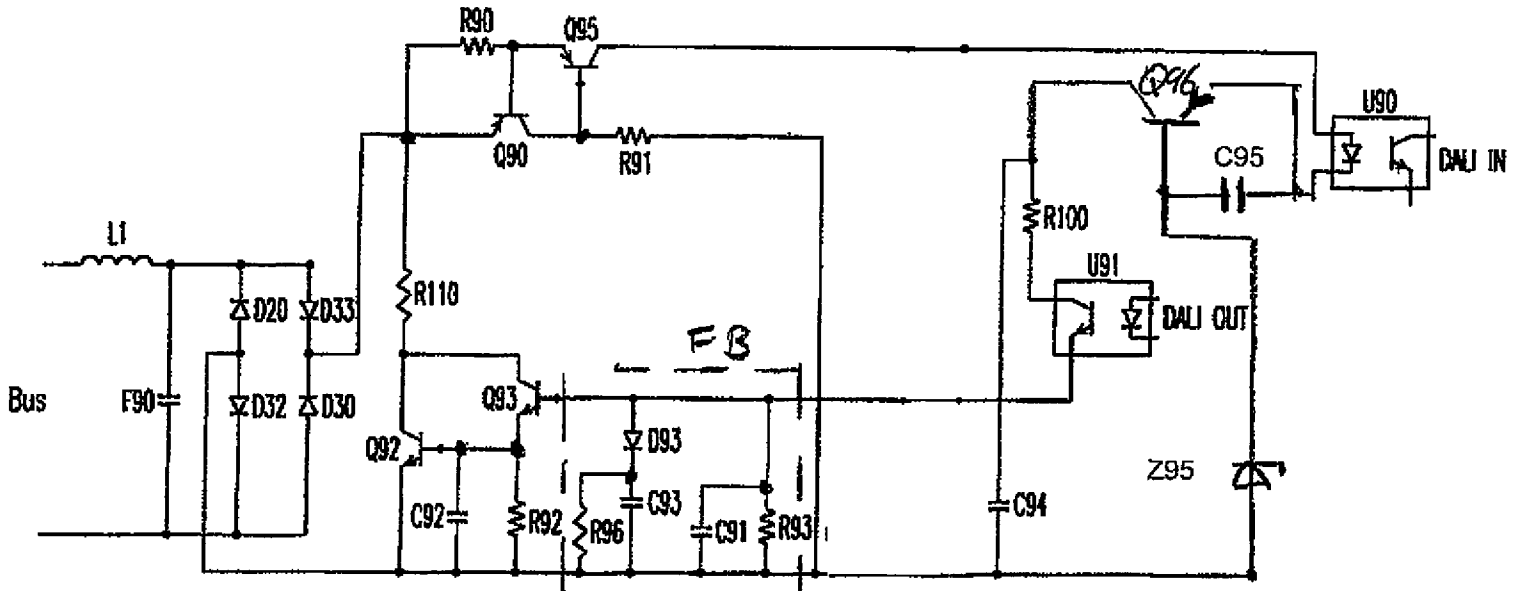
FIG. 5 a second embodiment according to the invention.

Reduced edge sides (that is, steeper edges) can be achieved with the circuits illustrated in FIG. 4 and FIG. 5. For example, edges with a time duration of less than 25 ms, preferably even less than 15 ms, can be achieved. For the case that a potential-carrying bus in the non-operating state is used (for example, the DALI bus), these time durations therefore relate to the time duration until the edge of a transmitting bit has drawn the bus potential to the lower potential, or respectively, the rear edge of the transmitting bit once again allows the bus potential to rise from the low potential to the non-operating potential.

In FIGS. 4 and 5, the two clips for connection of two bus lines, for example, for a DALI bus, are illustrated in each case on the left-hand side.

On the right-hand side, an optocoupler designated with 'DALIin' is illustrated in each case. On its primary side U90 (left side of the optocoupler in the FIGS.), incoming signals from the bus are fed in by means of a current source (the Darlington circuit Q90, Q95), which are then accordingly transmitted by the optocoupler in an electrically isolated manner. On the secondary side of the optocoupler DALIin, the further evaluation is then implemented by a control circuit in the operating device for lighting means and the control of the lighting means corresponding to the information received via the bus.

On the primary side of the further (transmitting-side) optocoupler DALIout, U91, the digital signals to be transmitted by the control circuit of the operating device for lighting means are connected and transmitted in an electrically isolated manner to the secondary side. The secondary side then comprises a circuit which can selectively short-circuit the bus.

In principle, the energy supply for the region of the circuit between the secondary side of the optocoupler Q91 and the bus is implemented via the bus voltage and the controlled current source Q90, Q95.

However, a problem occurs in that, in the case of the transmission of a digital signal, the front edge of the digital bit selectively short-circuits the bus voltage and accordingly draws it to a lower potential. In turn, this means that the previously still available energy supply for feeding the current source Q90, Q95 is eliminated as a result. The energy supply can therefore now only be implemented, for example, from capacitors in the interface circuit itself, which represents an uncontrolled energy supply, which therefore leads to problems with the precise adjustment of the edge characteristic, but also to feedback effects which can lead to oscillations (ringing). In order to minimise these feedback effects with regard to their interfering influence, filtering components must therefore be adopted into the interface circuit, which, in turn, slow down the time-response behaviour. Altogether, this ultimately leads to a restriction with regard to the edge characteristics and bit repetition rates which can be adjusted.

According to the invention as illustrated in FIGS. 4 and 5, it is therefore provided that the current source Q90, Q95 fed from the bus voltage charges an electrical energy store, in the illustrated example, the capacitor C94. By preference, this charging takes place without current controller present between the current source Q90, Q95 and the capacitor C94. However, the transistor-linear controller illustrated previously in the exemplary embodiments can also be present here.

Furthermore, it is significant that the discharging of the capacitor C94 takes place in a controlled manner via an ohmic resistor R100, which is connected, for example, between the energy store and the optocoupler.

This controlled discharge by means of a constant discharge current will therefore take place when the current source Q90, Q95 can not only operate correctly, that is, selective short-circuiting in the time range of the transmitting bit in the case of loss of the bus voltage. The capacitor C94 is discharged with a controlled current via the resistor R100.

In this context, the energy store capacitor C94 and the ohmic resistor R100 defining the discharge current are matched in such a manner that, during the transmission duration, that is, during the short-circuit of the bus voltage, the energy store capacitor C94 is still not completely discharged, and a constant discharge current therefore flows safely through the resistor R100 and the secondary side of the optocoupler U91 throughout the entire time duration of the transmission bit (short-circuit of the bus).

A further exemplary embodiment of the present invention will now be explained with reference to FIG. 5.

According to the exemplary embodiment of FIG. 5, a switch Q96 is now provided in the receiving branch, which comprises the receiving optocoupler U90. This switch Q96 can be, for example, a transistor, for example, a bipolar transistor, in particular, as shown in the present example, a PNP bipolar transistor.

The transistor Q96 is connected at its base to a Z diode Z95.

When the voltage across the Z diode Z95 has reached the Zener voltage (for example, in 5.7 V), the switch (transistor) Q96 is switched into the conducting state (connected through) and accordingly allows a flow of current to the primary side of the receiving-side optocoupler U90. This flow of current is fed through the current source R90, R91, Q90, Q95, as already explained in the context of the preceding exemplary embodiments.

As evident from FIG. 5, an energy storage element, in particular, a capacitor C95, is connected in the path upstream of the Z diode Z95. Expressed more precisely, this capacitor C95 is connected between the connecting point of the base of the transistor Q95 beneath the cathode of the diode Z95 and the connecting point of the emitter of the transistor Q96 and the cathode of the receiving optocoupler U90. Now, this capacitor C95 causes a short delay in the connection of the transistor Q96 when an adequate voltage is available from the bus.

By means of this switch (transistor) Q95, a particularly advantageous interface circuit can now be achieved, in which, at the input side (left-hand side "bus" in FIG. 5), digital signals according to the DALI or respectively the DSI standard can be connected, but also momentary-contact switch signals, in which a supply voltage is manually short-circuited, can be connected.

The circuit block FB in FIG. 5 contains a two-stage circuit for matching the edge steepnesses in the case of the transmission, that is, in the case of the controlling of the transistor Q92, by means of which the bus lines can be selectively short-circuited.

The invention claimed is:

1. A digital bus interface for an operating device for a lighting means, wherein:

the interface comprises a transmitting branch and a receiving branch, the receiving branch comprises a current source (R90, R91, Q90, Q95) which can be fed from a bus carrying voltage in the non-operating state, the current source (R90, R91, Q90, Q95) supplies at least the transmitting branch with energy, and the transmitting branch comprises an optocoupler (U91), the receiving branch comprises a further optocoupler (U90), in the receiving branch, a switch (Q96) is provided which is arranged in such a manner that the primary side of the optocoupler (U90) of the receiving branch is selectively switched into a conducting condition, so long as the voltage at the input of the receiving branch exceeds a defined threshold value.

2. The interface according to claim 1, wherein the switch (Q96) switches the primary side of the optocoupler (U90) of the receiving branch selectively into a conducting condition when the voltage in a non-linear element, in particular a Z-diode (Z95), exceeds a defined value.

3. The interface according to claim 1, wherein the edge duration of one digital bit which short-circuits a connectable bus is less than 25 mS, preferably less than 15 μS.

4. A building-technology bus system, comprising at least one bus device with an interface according to claim 1.

5. A balun for lighting means, in particular, gas discharge lamp, LEDs or OLEDs, with an interface according to claim 1.

6. A lamp comprising a lighting means, in particular, gas discharge lamp, LEDs or OLEDs, and a balun according to claim 5.

7. The interface according to claim 1, in which, in the receiving branch, an electrical energy store (C94) is provided, which is charged through the series circuit of current source (R90, R91, Q90, Q95) and switch (Q96), and which is discharged via a resistor (R100) in series with the secondary side of the optocoupler (U91) of the transmitting branch.

8. The interface according to claim 7, wherein the resistor (R100) is connected between the energy store (C94) and the optocoupler (U91).

9. The interface according to claim 7, wherein the energy store (C94) and the resistor (R100) are dimensioned in such a manner that, during the transmission duration of one digital bit, during which a connectable bus is short-circuited, a discharge current flows.

10. The interface according to claim 7, in which the energy store (C94) is charged without charging-current control element or via a charging-current control transistor starting from the current source.

11. A digital bus interface for an operating device for a lighting means, wherein the interface comprises:

a transmitting branch and a receiving branch, wherein the receiving branch comprises a current source (R90, R91, Q90, Q95) which can be fed from a bus carrying voltage in the non-operating state, wherein the current source (R90, R91, Q90, Q95) supplies at least the transmitting branch with energy, and the transmitting branch comprises an optocoupler (U91), wherein, in the receiving branch, an electrical energy store (C94) is provided, which is charged through the current source (R90, R91, Q90, Q95) and which is discharged via a resistor (R100) in series with the secondary side of the optocoupler (U91) of the transmitting branch.

* * * * *